United States Patent [19]

Timmer et al.

[11] 4,146,405

[45] Mar. 27, 1979

[54] UNITARY DISHWASHER

[75] Inventors: Henry Timmer, 2705 Rockhill Dr., Grand Rapids, Mich. 49505; George L. Troyer, Grand Rapids, Mich.

[73] Assignee: Henry Timmer, Grand Rapids, Mich.

[21] Appl. No.: 760,732

[22] Filed: Jan. 19, 1977

[51] Int. Cl.[2] ..... B08B 3/02

[52] U.S. Cl. ..... 134/115 R; 134/176; 134/180; 134/200; 312/311

[58] Field of Search ..... 134/115 R, 115 G, 143, 134/172, 176, 179–181, 200, 103, 25 A, 104; 312/311, 236, 209, 228–229, 253

[56] References Cited

U.S. PATENT DOCUMENTS

| | | | |
|---|---|---|---|
| 2,802,477 | 8/1957 | Levit | 134/115 G X |
| 3,059,653 | 10/1962 | Ingolia | 312/229 X |
| 3,082,779 | 3/1963 | Jacobs | 134/103 X |
| 3,177,095 | 4/1965 | Gibson | 134/25 A |
| 3,514,330 | 5/1970 | Schaap et al. | 134/115 R |
| 3,709,236 | 1/1973 | Field et al. | 134/176 X |

FOREIGN PATENT DOCUMENTS

| | | | |
|---|---|---|---|
| 560909 | 10/1957 | Belgium | 134/172 |
| 577302 | 7/1976 | Switzerland | 134/181 |

*Primary Examiner*—Robert L. Bleutge

*Attorney, Agent, or Firm*—Glenn B. Morse

[57] ABSTRACT

A complete dishwasher and sink assembly, including equipment usually installed separately, forms a unit that can be inserted in a cut-out in a countertop, and supported and secured in position at a peripheral flange. The connections to the associated utilities are positioned for maximum convenience to standard locations. A sink is pivotally mounted to provide a cover for the dishwasher chamber, and stiffener-deflector arrangements are provided to assure that the interior spray does not produce leakage out to the countertop through ventilation passages at the peripheral flange. Spray is applied to racks of dishes, preferably from rotating spray heads mounted on a movable carrier, with the supply of water to the spray heads being conducted via the hollow interior of the carrier and also the hollow interior of a sequence of interconnected links. The rotatable spray heads are also hollow, with molded projections forming directional jet orifices. The reciprocating carrier is supported on a rotatable double-helix screw shaft, with a portion of the carriage in sliding engagement with the wall of the spray chamber so that the carriage is suspended from the shaft. An auxiliary interior faucet is provided for rinsing dishes, with the spigot position determining the off-on condition of an associated valve.

5 Claims, 36 Drawing Figures

FIG. 3
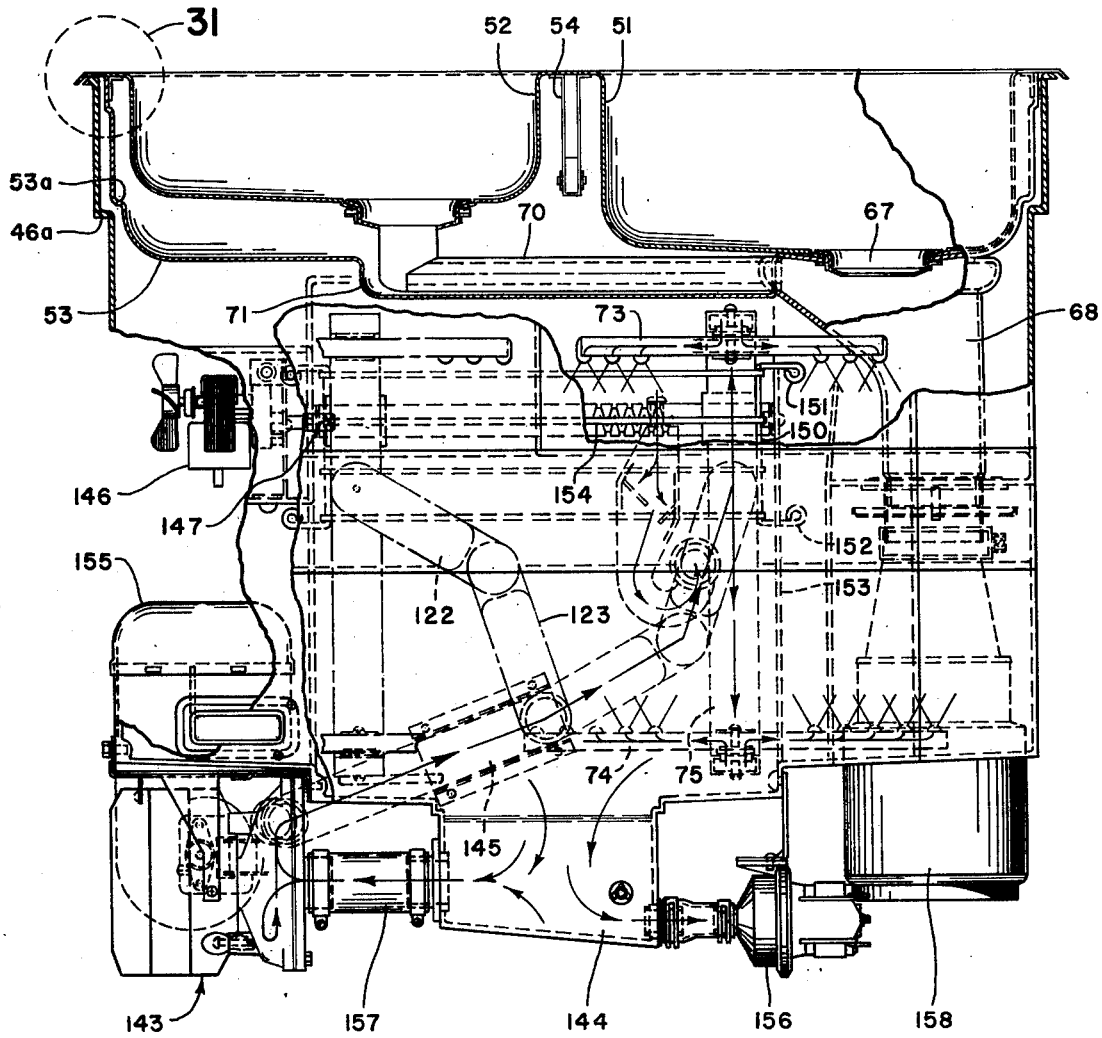
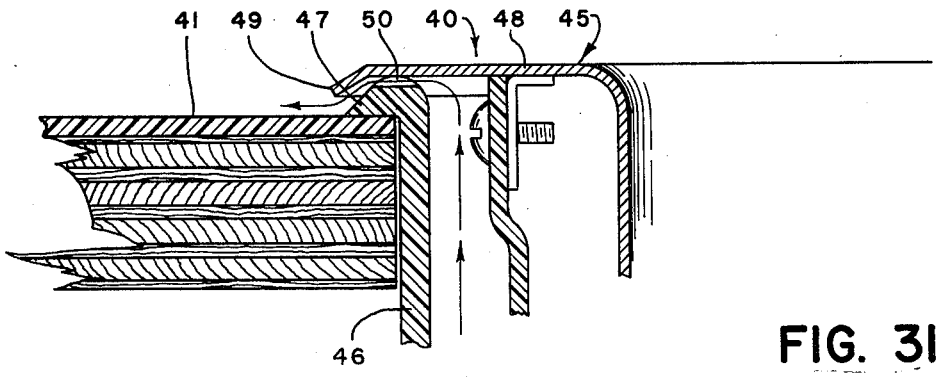
FIG. 31

169
170
171
172
173
174
175
176
177
178
179
180a
180b
181
183
184
185
186
187
188
189
190
191
192
193
194
195
196
197
198

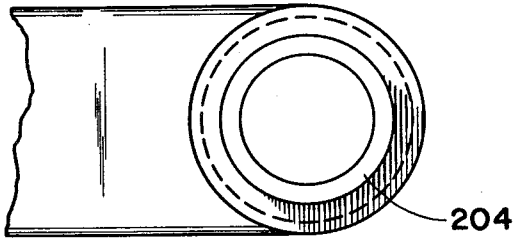
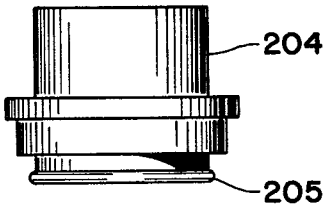
FIG. 34
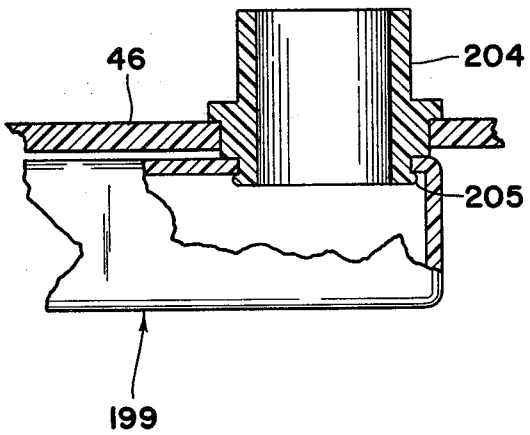
FIG. 35
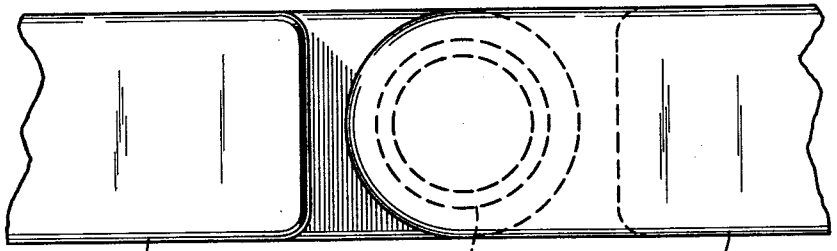
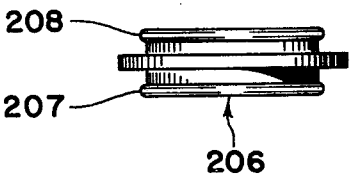
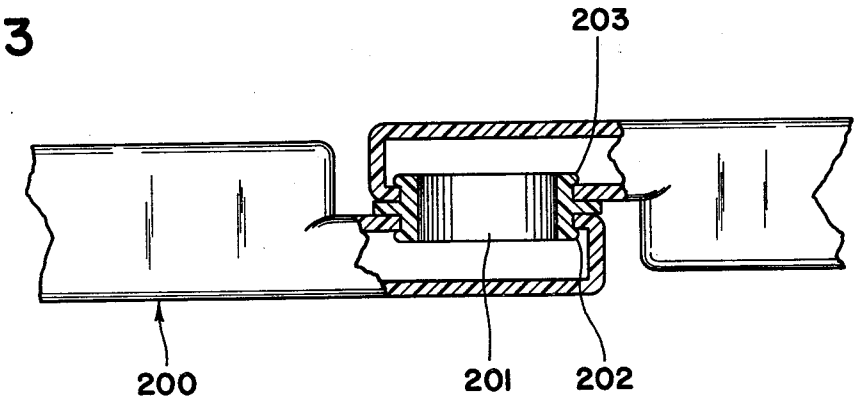
FIG. 36
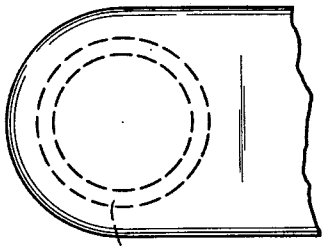
FIG. 33
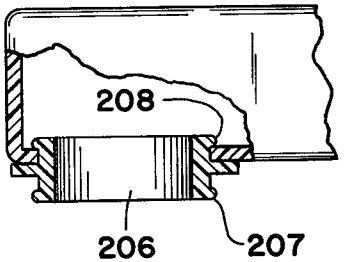

UNITARY DISHWASHER

BACKGROUND OF THE INVENTION

Dishwashing mechanism has been developing along a variety of lines, and this development has been sufficiently intensive that several types may be considered as competitive with respect to washing efficiency, ease of installation, simplicity of components, and inclusion of auxiliary features. The general concept of positioning dishes in open racks within a spray chamber, and washing them with moving spray heads using either fresh or recirculating water in conjunction with suitable detergents, has long since been established. Rotative spray heads mounted on moving carriers have become one of the standard ways of delivering the washing spray. Some forms of dishwashers have front-opening doors providing access to the interior, and another provides access from the top by tipping up a sink that functions also as a cover for the spray chamber. In this latter type of device, provisions have been made for a disconnectable drain to the sink that couples with the drain conduit when the sink is in the down position. The present invention is of this general type. Several different washing, rinsing, and drying cycles have been developed around these various types of mechanism. The extent of these lines of development is clearly shown in the numerous patents in the field. The following are cited as typical, but by no means an exhaustive list:

| Patent Number | Inventor | Date |
|---|---|---|
| 3358702 | T. Schaap | |
| 3356097 | T. Schaap | 12/5/67 |
| 3454019 | C. DeLeedy | 1969 |
| 3504683 | H. Timmer, et al. | 1970 |
| 3514330 | T. Schaap, et al. | 1970 |

SUMMARY OF THE INVENTION

A tank-shaped structure defining a spray chamber is adapted for insertion in a standard opening in a countertop. A sink is hinged to the tank structure, and has a flange overlying a peripheral support flange on the tank in spaced relationship to provide an exhaust vent passage for drying air introduced into the chamber during the drying cycle of the machine. Water-circulating equipment and garbage-disposal unit are mounted on the tank in positions permitting insertion of the entire assembly in the countertop opening. The tank and sink configuration provides stiffening, and also deflection for interior spray particles to prevent leakage out on the countertop via the vent passage.

The washing water is delivered to hollow rotating spray heads mounted on a laterally-reciprocating carrier suspended from a double-helix traverse screw. A portion of the carrier slides along the tank wall along a line spaced below the screw. Carrier movement is accomodated by a flexible conduit formed by interconnected hollow links communicating with a source of water pressure in the tank wall. All of these conduit components are preferably designed for manufacture as hollow molded parts, with discharge orifices in the spray heads being cut into integral dome-shaped projections in the walls of these members. An interior faucet is positioned to use the lower section of a disconnectable sink drain during periods in which the sink is elevated. The lateral swinging position of the spigot controls a valve associated with the spigot.

DESCRIPTION OF THE DRAWINGS

FIG. 3 is a sectional front elevation on a central plane through the structure shown in FIG. 2.

FIG. 31 (refer to sheet 3) is an enlarged fragmentary section at the junction of the periperal flange of the machine with the countertop, showing the vent passage.

FIG. 33 is an assembly partially in section, of an alternate arrangement for interconnecting the conduit links.

FIG. 34 is a plan view of the coupling member connecting the linkage to the tank wall in FIG. 33.

FIG. 35 is a plan view of the coupling member connecting the links in FIG. 33.

FIG. 36 is an elevation of the assembly shown in FIG. 33.

DESCRIPTION OF THE PREFERRED EMBODIMENTS

Figure 1:
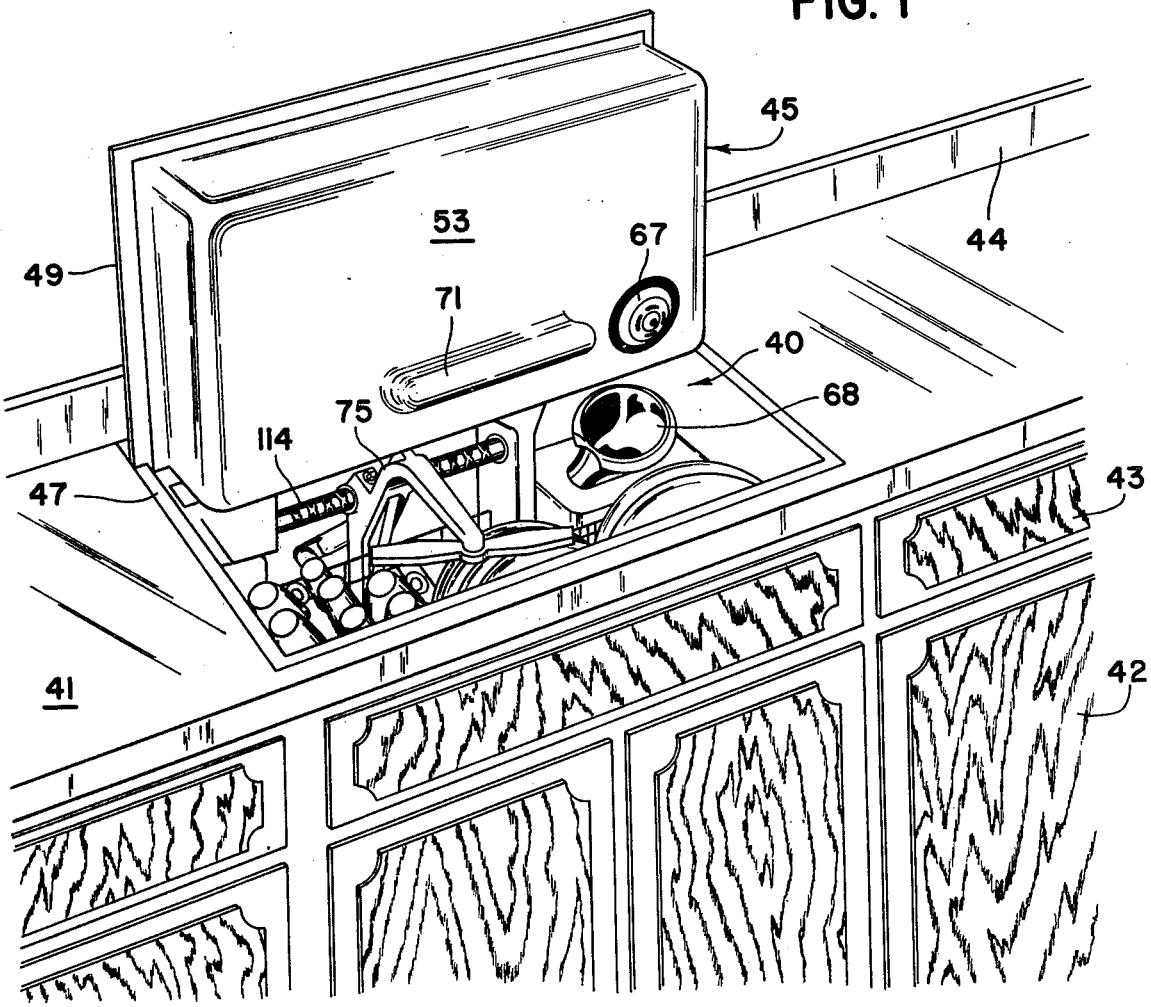
FIG. 1 is a perspective view of a complete unit shown installed at a conventional counter top, with the sink in the elevated position.

FIG. 1 illustrates a complete dishwasher-sink assembly indicated generally at 40 installed in a standard opening in the countertop 41. The structure of the counter is conventional, with the front being defined either by fixed panels, or by cabinet doors and drawers indicated at 42 and 43. It is standard practice to provide a back rail 44 defining the rear of the countertop 41 at the juncture with a conventional wall structure. The sink assembly indicated generally at 45 is hinged to the rear of the unit 40 at a position spaced slightly to the front of the rail 44, so that it can form a cover to the spray chamber providing access to the interior for the placement and removal of dishes. The walls of the tank 46 defining the spray chamber form the structural base of the machine, and are provided with a peripheral flange 47 overlying the countertop 41, and thus supporting the entire assembly and its associated equipment. The top panel 48 of the sink assembly 45 has a flange 49 overlying the peripheral flange 47 of the tank in spaced relationship to provide a vent passage as indicated by the arrows in FIG. 31. Abutments as shown at 50 are preferably integral with the flange 47, and bear on the underside of the sink flange 49 to maintain this spaced relationship.

The sink assembly 45 is a composite of several pan-shaped members including the sink sections 51 and 52, both of these being received in the housing receptacle 53. Spaced offsets in the housing 53 and tank 46, as shown at 53*a* and 46*a* in FIG. 3, provide stiffening, and also for deflection of spray particles so they do not emerge at the vent passage shown in FIG. 31. In the space between the sections 51 and 52, a bracket 54 secured to the top panel 48 forms a terminal for one end of the extendable spring-balanced restraining device 55, constructed along the lines of an internally-biased hydraulic door closer. The opposite end of this device is connected to the bracket 56 secured to the wall of the tank 46 with fastenings as shown at 57 and 58. A stiffener 59 is preferably incorporated to receive the fastenings 57 and 58, with the lower extremity secured to the offset 60 in the tank with fastenings as indicated at 61. The upper extremity of the stiffener 59 is preferably spot-welded to the fixed rear panel 62 of the machine to which the sink assembly is hinged at 63. The opposite leaves of the hinge are preferably spot-welded to the panel 62 and to the top panel 48 of the sink assembly. A standard faucet is also usually secured to the fixed panel 62 to provide the swingable spigot 64, with the valve 65 under the control of the handle 66. In the down position of the sink shown in FIG. 3, the outlet 67 (refer to FIG. 3) interengages with the open top of the lower drain section 68, which has a funnel-shaped configuration to facilitate receiving material scraped from dishes. The sink section 62 has an outlet 69 communicating with a transverse drain 70 received within the trough-shaped portion 71 of the housing 53. The transverse drain 70 also communicates with the open top of the drain section 68 in the down position of the sink.

Figure 5:
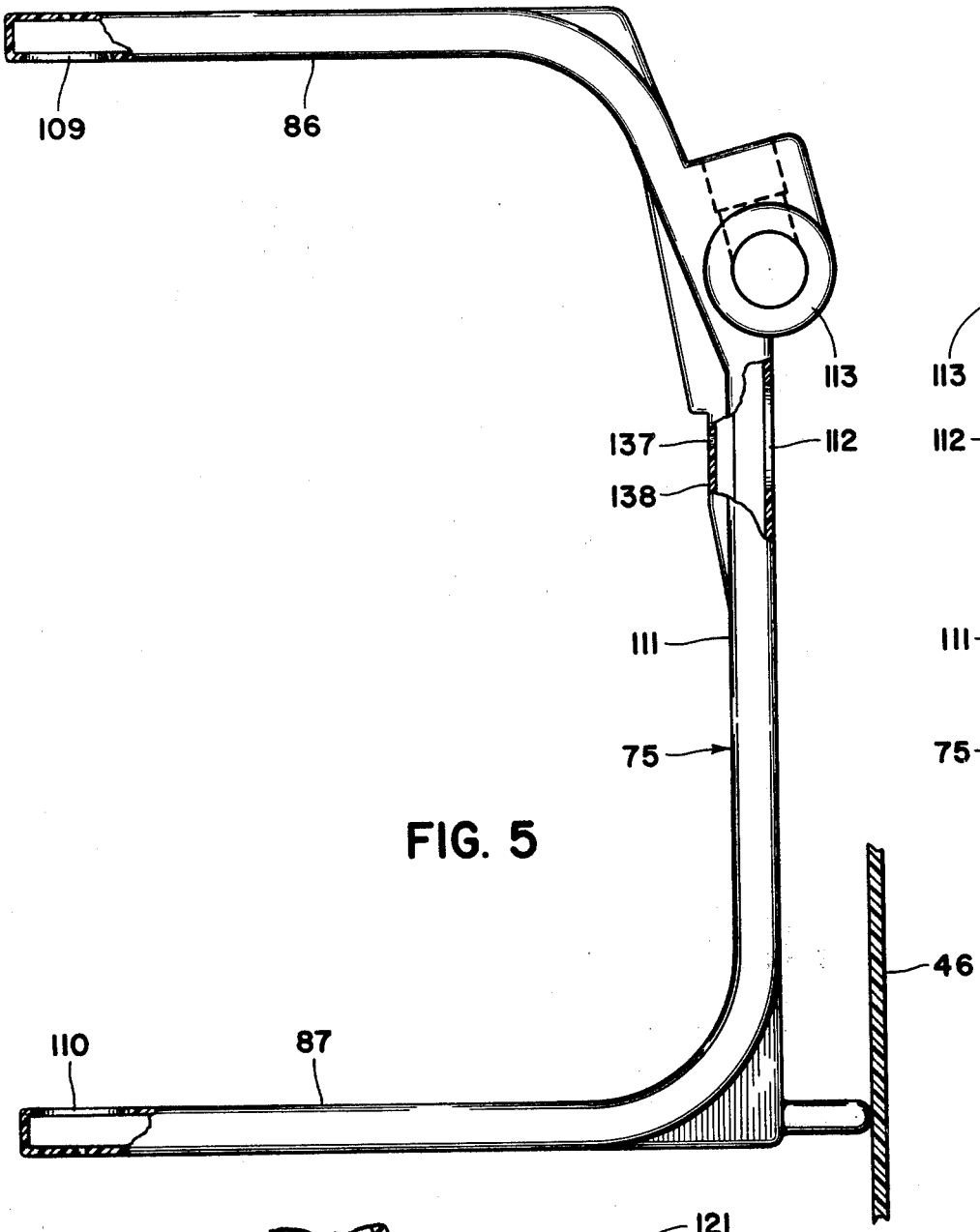
FIG. 5 is a side elevation showing the spray head carrier.
Figure 6:
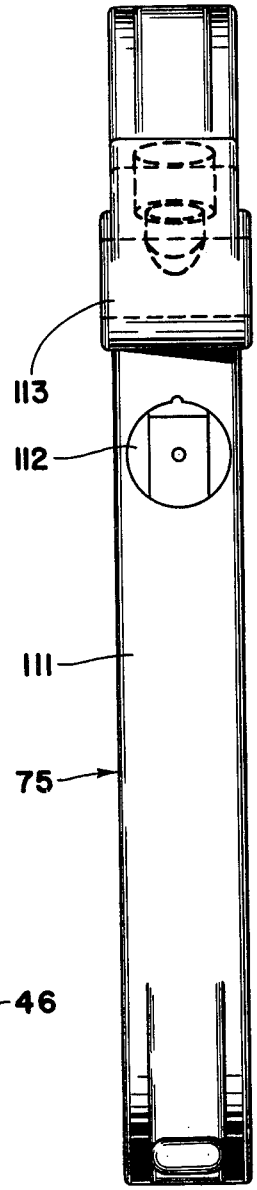
FIG. 6 is a front elevation of the carrier illustrated in FIG. 5.
Figure 7:
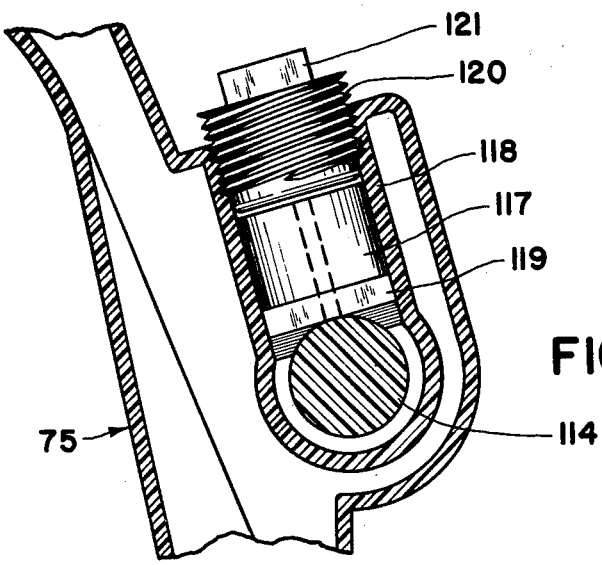
FIG. 7 is an enlarged fragmentary section showing the portion of the carrier in engagement with the traverse screw.
Figure 8:
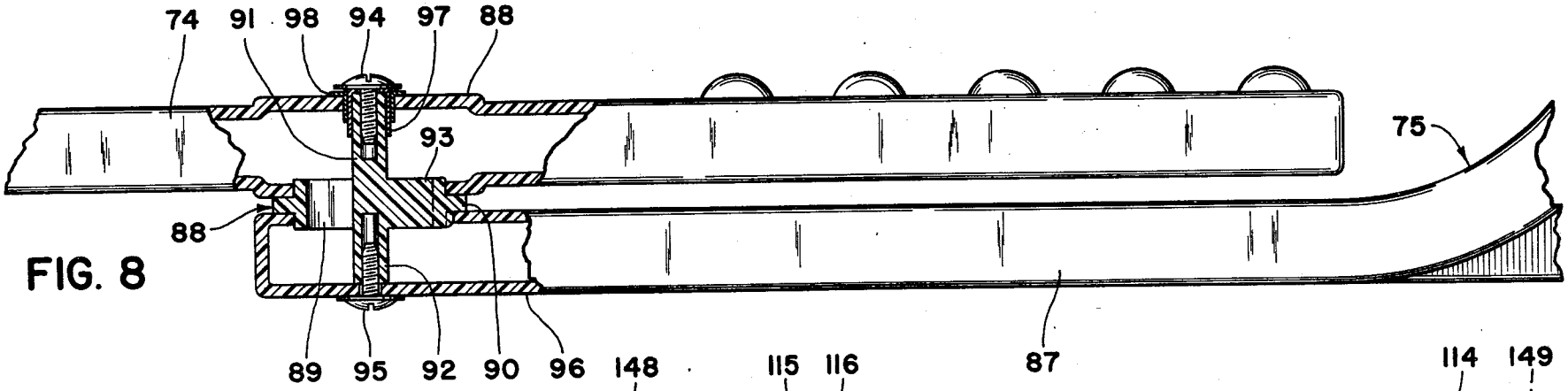
FIG. 8 is a fragmentary sectional elevation, on an enlarged scale, showing the relationship of the lower rotating spray head with the carrier.
Figure 10:
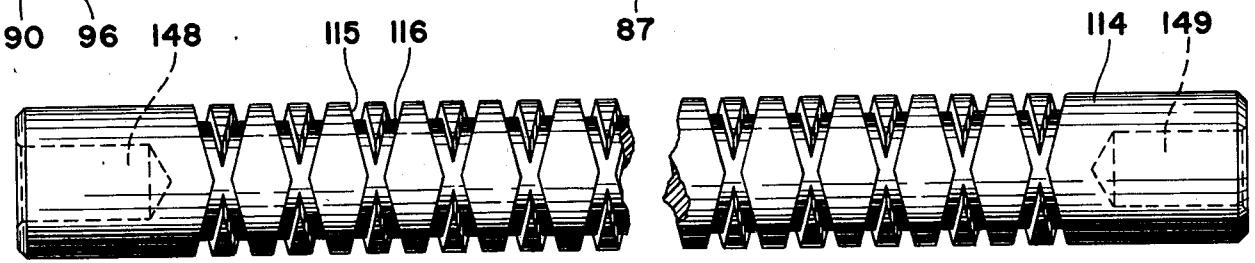
FIG. 10 is a front elevation showing the double-helix traverse screw.
Figure 9:
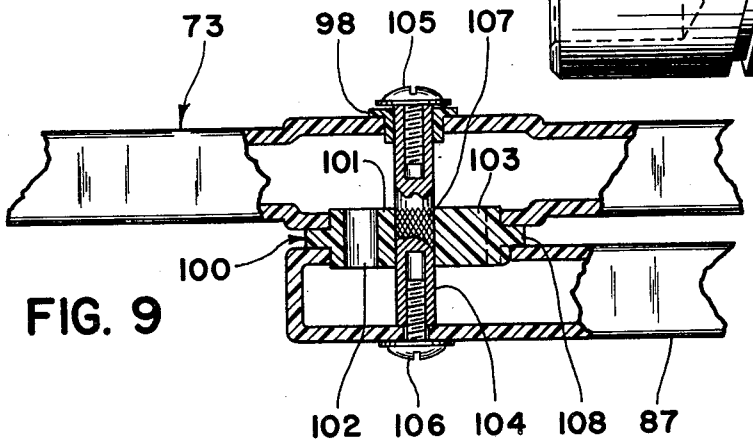
FIG. 9 illustrates a modified form of construction from that illustrated in FIG. 8.
Figure 14:
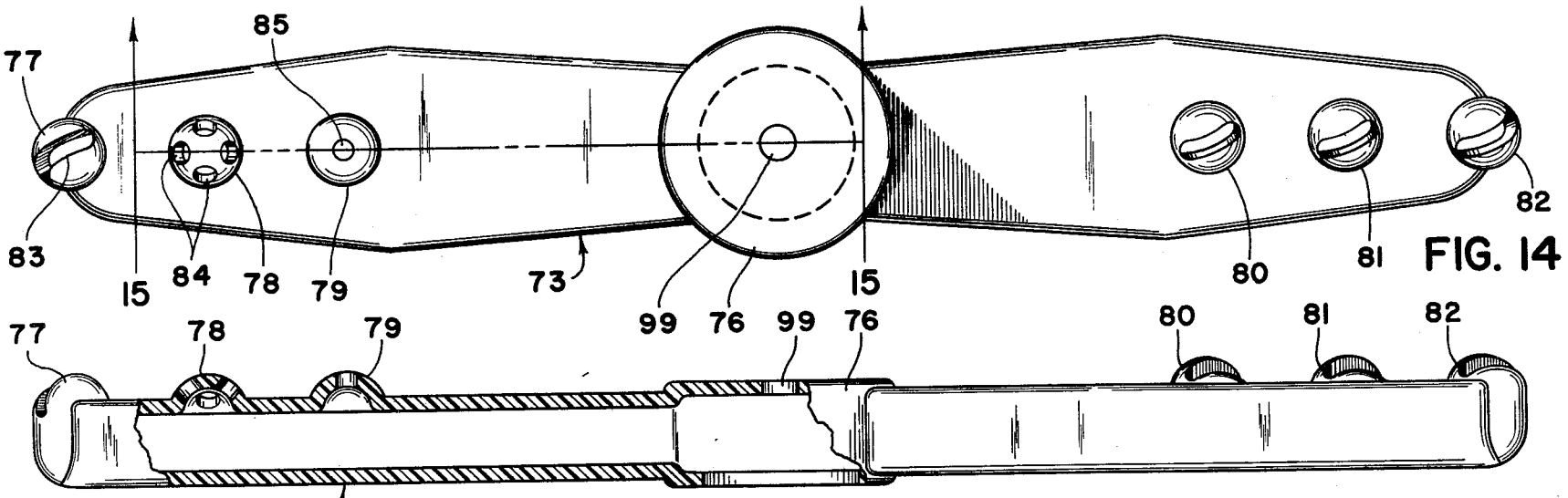
FIG. 14 is a plan view showing one of the rotating spray heads.
Figure 15:
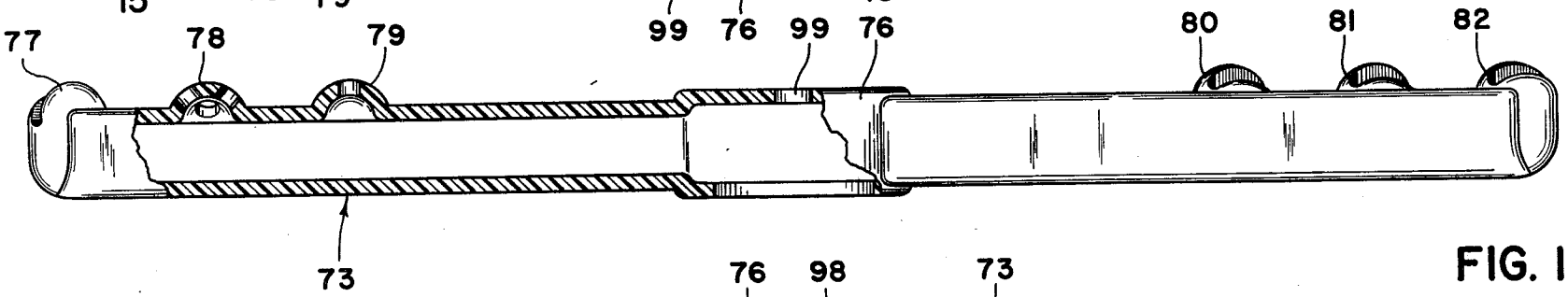
FIG. 15 is an elevation, partially in section, on the plane 15—15 of FIG. 14.
Figure 16:
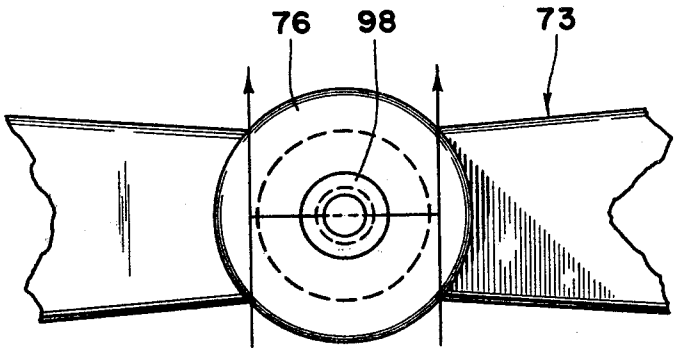
FIG. 16 is a plan view showing a bearing insert in the molded piece shown in FIGS. 14 and 15.
Figure 17:
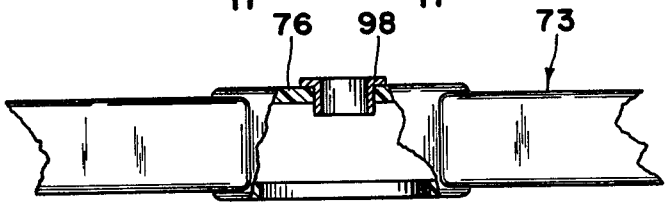
FIG. 17 is a front elevation in projection with respect to FIG. 16, partially in section on the plane 17—17 of FIG. 16.

An assortment of dishes is positioned within the spray chamber defined by the tank structure 46 by the open rack 72. The washing action is provided by the rotating spray heads 73 and 74 mounted on the carrier 75. The spray heads are substantially alike, and are shown best in FIGS. 14 and 15. These units are preferably molded in one piece by a technique commonly referred to as "rotational molding", which makes it possible to mold hollow objects in one piece without the use of cores. The propeller-shaped rotors function as water conduits leading from the central hub 76 radially outward to the dome-shaped projections 77–82, which are molded as continuous imperforate projections. After the molding operation, openings of various configuration as shown at 83–85 are cut or drilled to provide for a desired type of spray oriented in a particular direction so as to give a reaction effect to spin the rotor. Certain of these apertures may be cut purely for reaction purposes, with the remainder directed and shaped to provide particular spray conditions within the chamber. The rotors 73 and 74 are generally similar in configuration, but may vary with respect to the lengths of the arms and the configuration of the discharge orifices. The rotor 73 is mounted on the upper arm 86 of the carrier 75, and the rotor 74 on the lower arm 87 (refer to FIG. 5). In both cases, the structural details of the rotatable mounting are as shown in FIG. 8. The insert 88 has the dual function of a bearing for the rotors, and also a conduit communicating in between the hollow interior of the arms 86 and 87 and the hubs 76 and 88 of the rotors 73 and 74, respectively. The tubular body portion 89 has a peripheral flange 90 functioning as a spacer to position the rotors with respect to the carrier arms. Opposite axial extensions 91 and 92 of the insert 88 are connected to the body portion 89 by the radial web or webs 93. The ends of the extensions 91 and 92 are tubular to receive the mounting screws 94 and 95, respectively. Preferably, the screw 95 tightly binds the end of the extension 92 to the wall 96 of the carrier arm 87, so that the insert 88 may be considered as fixed with respect to the arm 87. The extension 91 is provided with a tubular sleeve 97 held against the end of the axial extension 91 by the screw 94 to form a wear-resistant bearing surface for interengagement with the grommet 98 engaging the hole 99 in the hubs of the rotors. The provision of these wear-resistant bearing elements is optional, and the rotors may be mounted in the condition as they appear in FIGS. 14 and 15. The modification shown in FIG. 9 involves a minor deviation in the structure of the insert separating the rotors from the carrier arms. The rotor 73 may be identical to that appearing in FIGS. 16 and 17, but the insert 100 is molded without the axial projections 91 and 92. In place of this, a central hub 101 is connected to the tubular body portion 102 by the web portion 103, with a central hole being provided in the hub 101 to receive the metal pin 104. This pin receives the screws 105 and 106 in its opposite ends, respectively, and the central part of the pin is knurled as shown at 107 for a solid interengagement with the hub 101 under a press fit or as a mold insert. The material of the pin 104 removes the need for the sleeve 97, and the tightening of the screw 106 securely fixes the insert 100 with respect to the arm 87 of the carrier, leaving the rotor 73 to spin on the top surface of the flange 108 and around the pin 104. In both FIG. 8 and FIG. 9 arrangements, water moving through the carrier arm passes through the bearing-conduit inserts, into the hub portions of the rotors, and radially outward through the arms to the discharge orifices.

Referring to FIGS. 5–7 and 10, the carrier 75 is, like the rotors, preferably an integral hollow molded component manufactured through the rotational molding technique. The apertures 109 and 110 in the arms 86 and 87, respectively, are adapted to receive the body portions of the bearing inserts 88 or 100, and the central hollow portion 111 of the carrier functions as a conduit to distribute water from the inlet point 112 communicating with the tubular linkage assembly shown in FIGS. 11 and 12. An integral sleeve portion 113 surrounds the traverse screw 114, which has a double helix formed by the grooves 115 and 116 disposed on opposite helix angles. A follower plug 117 is rotatably mounted in the cylindrical section 118 of the carrier, and the follower has an end projection 119 capable of engaging either the grooves 115 or 116. The action of this follower with respect to these grooves is the same as that of the usual level-wind mechanism associated with fishing reels. The projection 119, if engaged with the groove 115, for example, will proceed to the end of the thread system on rotation of the screw 114. On arriving at that point, an appropriate abutment induces rotation of the plug 117 within the bearing section 118 so that the projection 119 instantly engages the opposite groove 116 to induce traverse of the carriage in the opposite direction. The assembly of the device is a simple procedure of slipping the carriage over the screw 114, followed by dropping the plug 117 through the aperture closed by the retaining screw 120. Tightening of the screw 120 by the application of a wrench to the squared projection 121 to any desired degree establishes the necessary confinement and operating clearance for the functioning of the follower plug 117.

Figures 11, 12, 13:
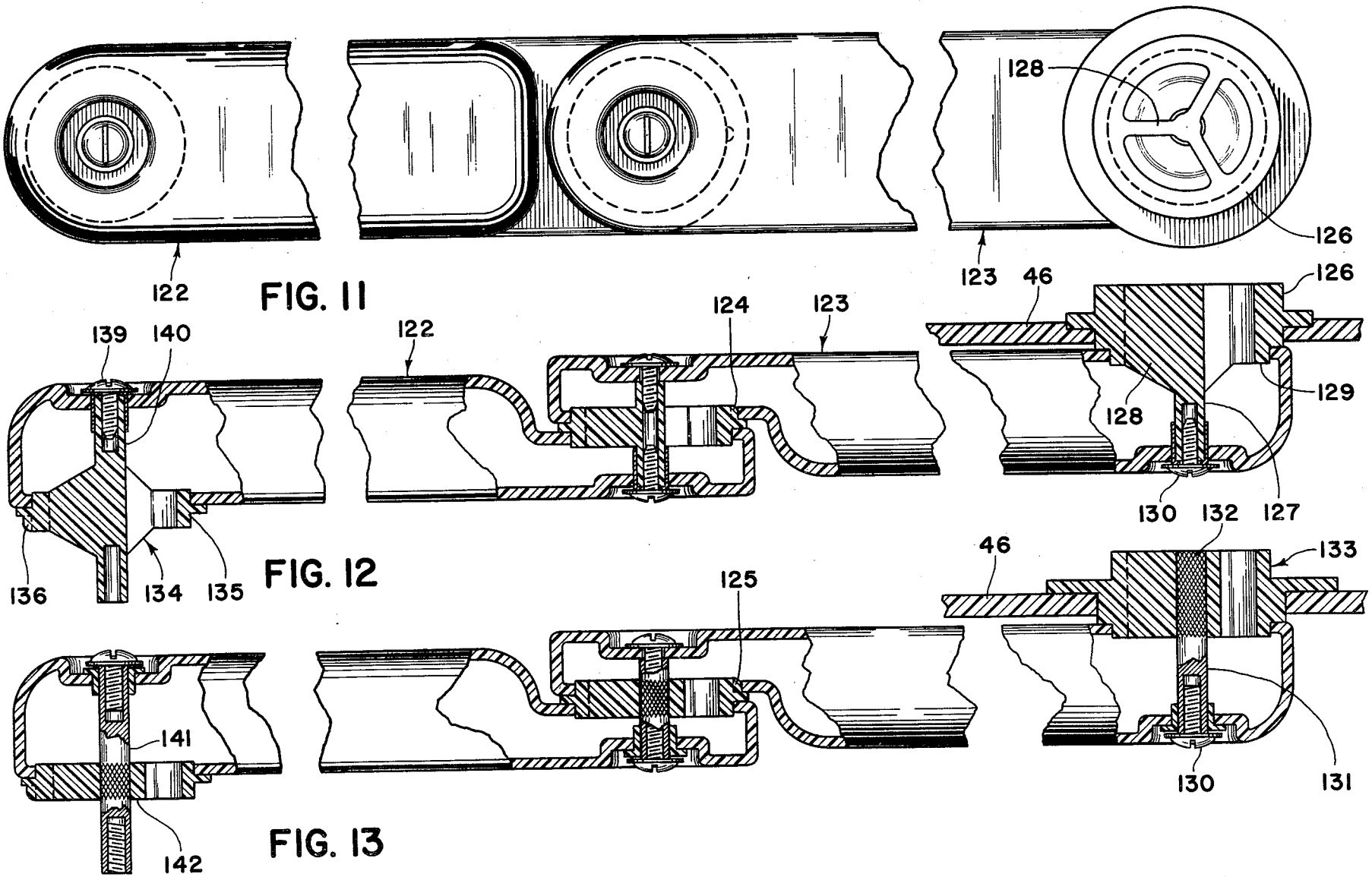
FIG. 11 is a front elevation, on an enlarged scale over that of FIGS. 2–4 showing the interconnected conduit links supplying water to the spray head carrier.
FIG. 12 is an elevation, partially in section, of the assembly shown in FIG. 11.
FIG. 13 illustrates a modified form of construction with respect to FIG. 12.

Water is conducted to the carrier for distribution to the rotors by the flexible conduit formed by the interconnected hollow links 122 and 123 shown in FIGS. 11–13. These are secured together by a pivot assembly which can be essentially similar to that appearing in FIGS. 8 or 9 for supporting the spray rotors, with the exception that the body portion of the inserts is preferably keyed to one of the links by a radially extending projection as shown at 124 in FIG. 12 or 125 in FIG. 13. These projections engage suitably disposed discontinuities in the otherwise circular openings in the arms receiving the bearing inserts. The opposite link is freely rotatable about the body portion of the conduit-bearing inserts, and about the associated axial projections or pivot pins, depending upon the version of the conduit-bearing insert selected. The interconnected tubular links 122 and 123 provide further examples of the convenient usage of the rotational-molding technique. Water is delivered to this flexible conduit assembly from the terminal 126, which is interengaged with the wall 46 of the spray chamber by appropriate fastenings or adhesive. The axial extension 127 of this terminal is secured to the tubular body portion by the web 128, with the cylindrical outer surface of the portion 129 rotatably receiving a suitable circular opening in the arm 123. The arm is held in engagement with this fulcrum by the retaining screw 130. FIGS. 12 and 13 show the same general differences in construction as that appearing by comparison of FIGS. 8 and 9. In summary, an integral molded axial extension as shown at 127 is replaced by the pivot pin 131, when this may be considered desirable. The knurled end of this pin is simply pressed, or molded as an insert, into the body portion of the fulcrum insert 133.

At the opposite extremity of the linkage assembly, the pivot connector 134 has a cylindrical surface 135 interrupted by the radial key 136 for engagement with an appropriate discontinuity in the opening 112 in the carrier 75. A suitable retaining screw traverses the hole 137 in the wall 138 of the carrier to receive a retaining screw similar to the screw 139 that loosely secures the arm 122 to the axial extension 140 of the pivot connector. In FIG. 13, the structure is replaced, as with the other corresponding structure at various points of pivotal relationship, by the use of the metal pin 141 pressed into, or molded as an insert in, the body portion of the pivot connector 142. The remainder of the adjacent structure differs between FIGS. 12 and 13 in the same way as in FIGS. 8 and 9.

The circulation of water within the machine is induced by the pump assembly indicated generally at 143 mounted at the bottom of the spray chamber, as shown best in FIG. 3. This pump takes water from the sump 144 and delivers it to the conduit 145 under pressure to the fulcrum terminal 126 for transmission to the carriage and rotors via the interconnected conduit links. Movement of the carriage between the positions shown at the left and at the right in FIG. 3 will thus be accommodated by the pivoted linkage, while continuing to supply water under pressure to generate the cleaning spray. The mechanism responsible for inducing this traversing movement centers in the motor 146 mounted on the exterior of the chamber 46, and having an output shaft coupled to a driving plug 147 received in a suitable bore 148 in the traverse screw (refer to FIG. 10). The coupling 147 may be of any desired arrangement, such as a cross-slot, spline, or other arrangement for torsional transfer. At the opposite end of the traverse screw 114, a similar bore 149 receives a journal projection (not shown) carried by the metal plate 150 having upper and lower extensions 151–152 slidably engaging a wall 153 of the chamber 46. This arrangement provides for lateral displacement of of the plate 150 for facilitating the assembly and disassembly of the traverse screw. The installed position of the components is maintained by the tie rod 154. This form of the structure is optional, and may be replaced by a variety of alternatives.

Figure 4:
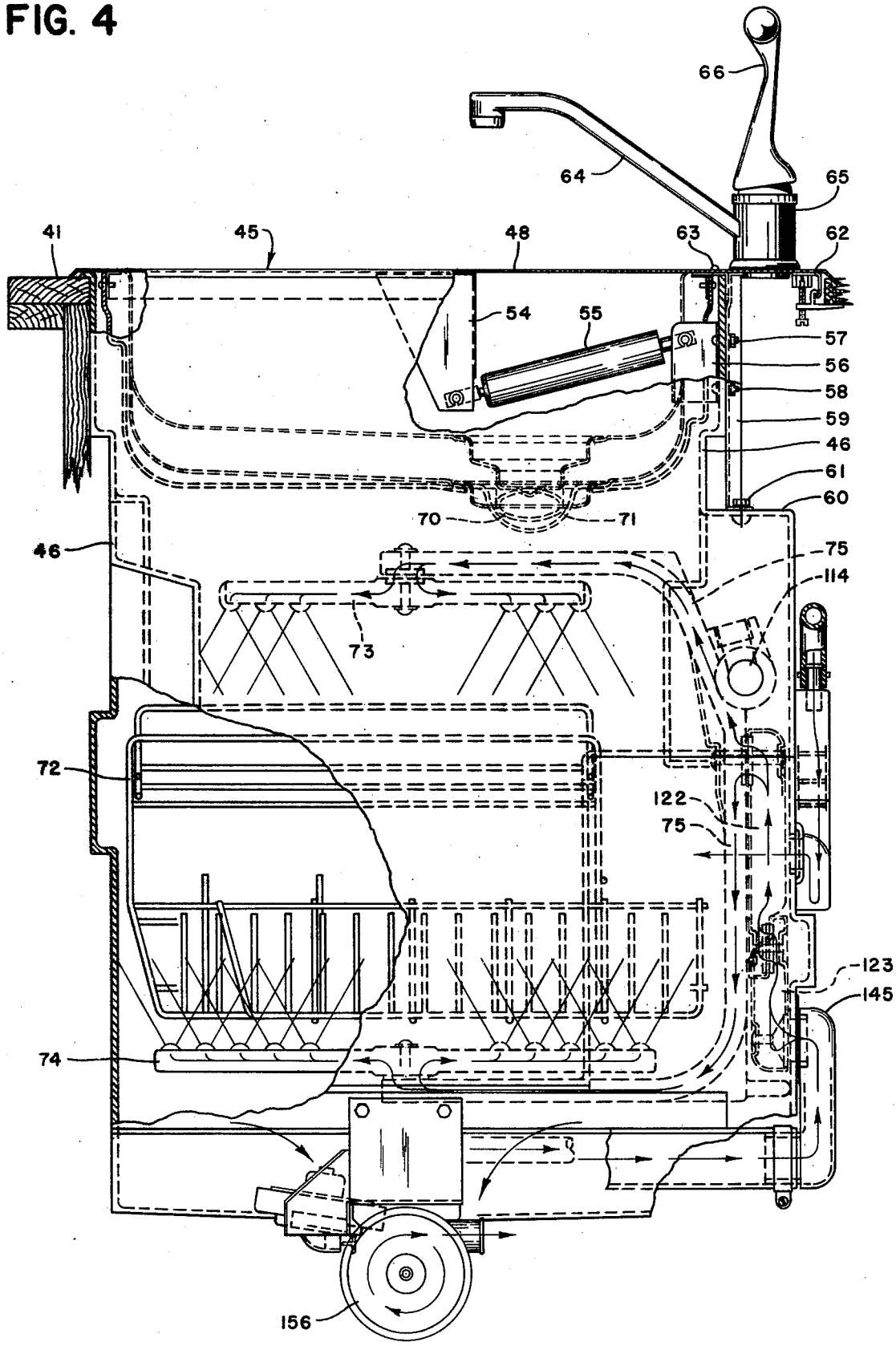
FIG. 4 is a sectional side elevation on a central plane through the structure shown in FIG. 2.

The drying cycle of the machine is provided by a blower and heating device indicated generally at 155. This unit is conventional, and simply delivers warm air in a selected pattern of circulation within the spray chamber after the spray cycle has been terminated. This drying air emerges through the path described in conjunction with FIG. 31. When the operation cycle of the machine has been completed, the drainage pump 156 shown in FIGS. 3 and 4 may be operated to discharge the contents of the sump 144, which is preferably small enough in cross section to concentrate the residue of the cleaning cycle, and need only be wide enough to provide for receiving the connection of the hose 157 leading to the recirculating pump 143. The garbage-disposal unit 158 will normally have its own exhaust system.

Depending on the needs of the particular installation, a variety of optional equipment may be incorporated in the machine. Hot and cold water intakes can be provided as shown at 159 and 160 in FIG. 2, controlled by solenoid-operated valves 161 and 162, respectively, which deliver their controlled output through the Y fitting 163 and a suitable connecting conduit (163*a*) to the standard air gap generally indicated at 163*b*. This unit supplies the machine initially with water. The safety device 164 is capable of emergency draining the sump 144 via the conduit 165. Conventional dispensers as shown at 166 and 167 can deliver desired quantities of detergent, bleach, or other materials for incorporation in the cleaning cycle. The various phases of the cleaning cycle are preferably controlled by a standard timing device indicated generally at 168.

Figures 18, 19, 20, 21, 22, 23, 24, 25, 26, 27, 28, 29, 30, 32:
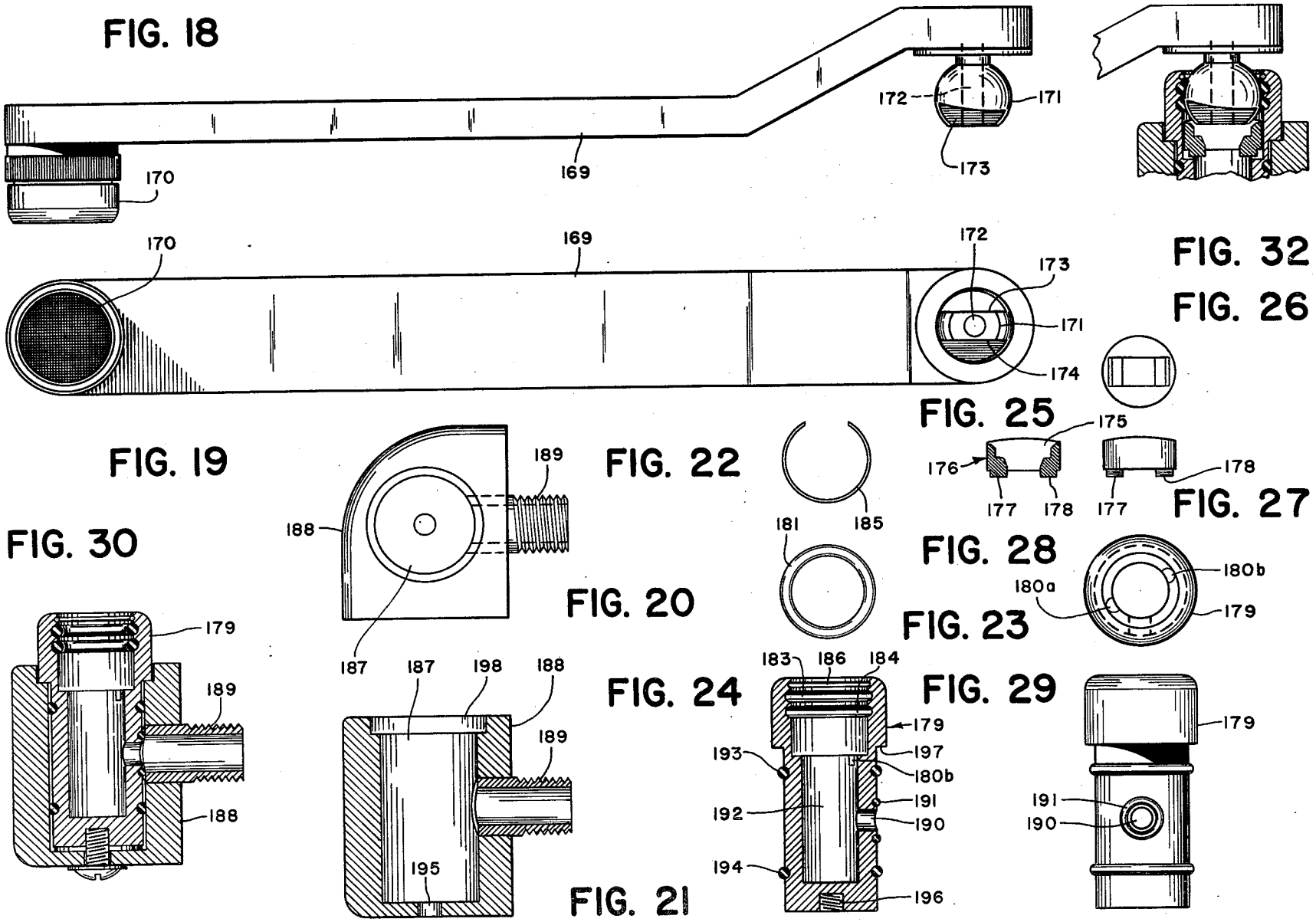
FIG. 18 is a side elevation showing a faucet spigot disposed on the interior of the spray chamber.
FIG. 19 is a plan view in projection with FIG. 18.
FIG. 20 is a side elevation of a valve body associated with the spigot illustrated in FIGS. 18 and 19.
FIG. 21 is a section through the central portion of the valve body illustrated in FIG. 20.
FIG. 22 is a retaining ring associated with the valve assembly.
FIG. 23 is a sealing O ring retained by the ring 22.
FIG. 24 is a rotatable valve element mounted in the valve body shown in FIG. 21.
FIG. 25 is a diametral section through a driving collar in engagement with the ball end of the faucet spigot.
FIG. 26 is a top view of the collar shown on FIG. 25.
FIG. 27 is a side elevation of the collar shown on FIG. 25.
FIG. 28 is a top view of the valve element shown in FIG. 24.
FIG. 29 is a side elevation of the valve element shown in FIG. 24.
FIG. 30 is a sectional assembly of the lower valve components.
FIG. 32 is a sectional assembly of the upper valve components.

The initial preparation of the dishes for the cleaning cycle centers in scraping them into the open end 68 of the drain section, and this process is facilitated by the interior faucet assembly illustrated in FIGS. 18–30 and 32. The tubular spigot arm 169 is generally rectangular in cross section, and terminates at its outer end in the usual aerating device 170. At the opposite extremity, a ball fitting 171 is permanently secured by brazing or any other convenient method. A bore 172 extends through the ball fitting to provide a water conduit communicating with the interior of the spigot arm 169. Notches are machined in the opposite sides of the lower end of the ball fitting to provide the driving flats 173 and 174 received within the diametral slot 175 in the torque-transfer ring 176. This ring has a pair of opposite projections 177–178 registering with corresponding recesses in the valve member 179, indicated at 180*a* and 180*b*. The spherical surface of the ball end 171 is entrapped between the rings 181 and 182, which are identical, and are as shown in FIG. 23. These are received in the annular grooves 183 and 184, respectively, in the valve member 179. This assembly is retained in position by the presence of the snap ring 185 received in the groove 186. The valve member thus permits the spigot arm to have considerable swinging movement in the up-down direction with respect to the valve member, and the valve member itself rotates about its vertical axis by virtue of the interengagement of the torque-transfer ring 176 with both the valve member and the spigot arm.

Figure 2:
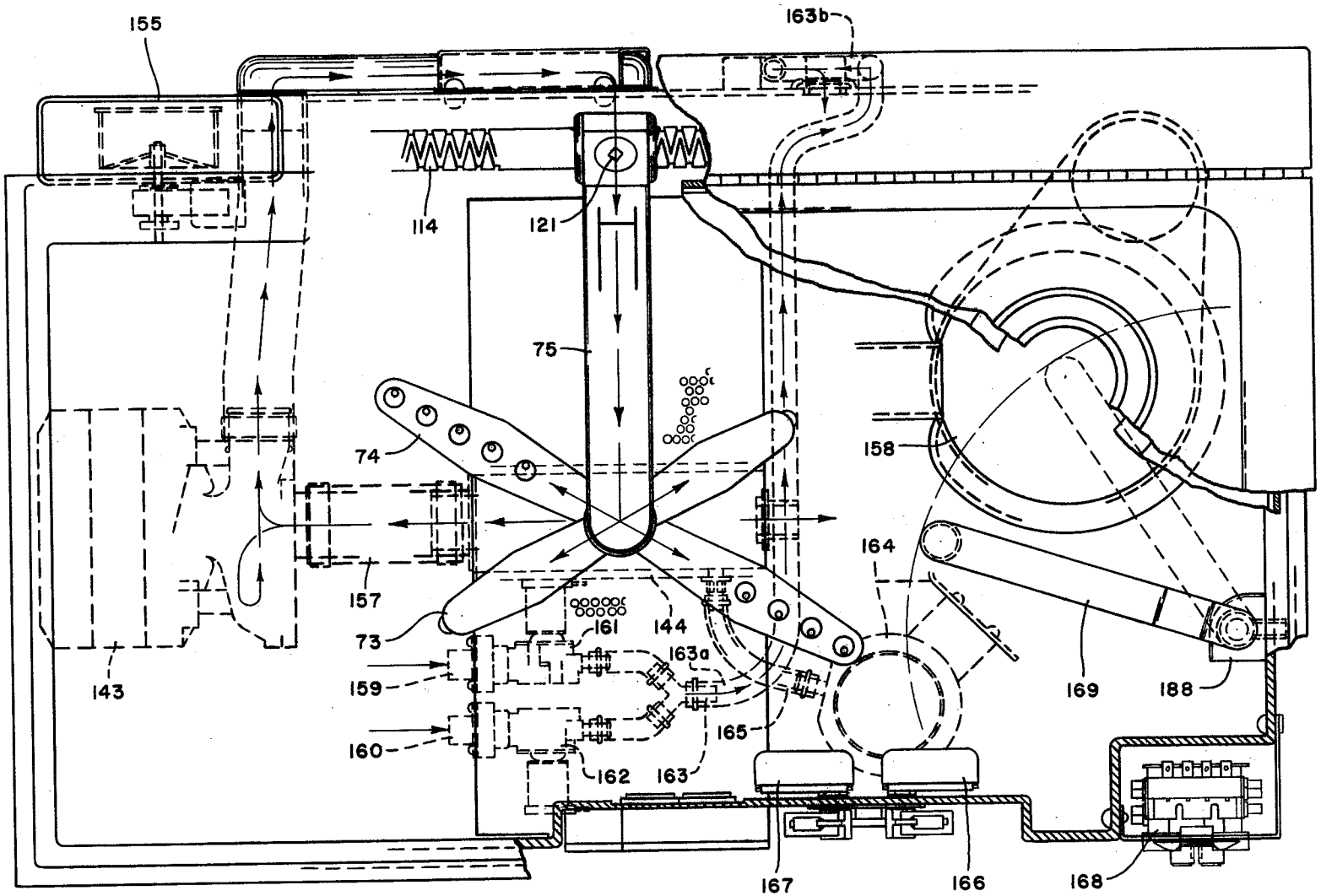
FIG. 2 is a plan view, partially in section, of the machine shown separately from the counter top structure.

The valve member is received within the bore 187 of the corner block 188, which is provided with an inlet conduit 189 associated with the water pressure system. An entry port 190 in the wall of the valve member is surrounded by an O ring 191, with the result that the alignment of the O ring 191 with the entrance opening into the bore 187 of the conduit 189 will admit water pressure to the interior chamber 192, through which the water is free to pass through the passage 172 in the ball end into the spigot arm 169. As the valve member 179 is rotated so that the O ring 191 is out of registry with the opening in the end of the conduit 189, the water pressure then finds itself entrapped in the space between the O rings 193 and 194, which seal the valve member against the wall of the bore 187. The valve member is held in engagement with the corner block 188 by a screw traversing the opening 195, and engaging the threaded hole 196. In the assembled condition, the offset 197 on the valve body engages the counterbore 198 in the corner block 188. The off-on position of the valve assembly associated with the arm 169 is determined such that the valve will be off when the arm is out of position where the discharge from the arm through the unit 170 could be received by the drain section 68. Referring to FIG. 2, swinging movement from the full line to the dotted line position (where the discharge from the arm would be received by the drain) would turn the valve to the "on" condition.

Referring to FIGS. 33–36, an alternate construction for the conduit linkage is illustrated which centers primarily in a difference in the structure of the pivot connections. The conduit links 199 and 200 are interconnected by the member 201, which has cylindrical opposite end portions with annular enlargements at the extremities shown at 202 and 203. These are proportioned with respect to the openings in the links 199 and 200 so that they are received in a snap-in relationship that will rely upon the resilient distortion of the material of these components for initial assembly. This degree of retention must be sufficient to resist whatever water pressure is present within the conduits, applied over the cross-sectional area of the cylindrical bore of the member 201. The interconnected linkage is pivotally mounted on the falcrum terminal 204 secured to the tank wall 46. The difference in structure here is the provision of the annular enlargement 205 received in an appropriate opening in the link 199 in the same snap-in relationship discussed in connection with the central pivot member 201. At the opposite end of the assembly, the fitting 206 has opposite annular enlargements 207 and 208 providing snap-in assembly with the carrier and with the link 200, respectively.

We claim:

1. A dishwasher assembly including tank means having a water inlet and a drain outlet, a carrier mounted in said tank means for movement along a predetermined path, spray means mounted on said carrier, and also including a spray head, drive means operative to induce movement of said carrier along said path, flexible conduit means communicating with said spray head and said water inlet, and dish-holding means in said tank means, wherein said flexible conduit means comprises at least two hollow conduit links pivotally interconnected for rotation about a first axis, one of said links being pivotally connected for rotation about a second axis to said water inlet, and the other of said links being pivotally connected for rotation about a third axis to said carrier, said carrier forming a conduit from said latter pivotal connection to said spray head, and said first, second and third axis being mutually parallel.

2. A dishwasher assembly including tank means and sink means pivotally connected to said tank means, said sink means forming an upwardly-opening hinged cover for said tank means, and also including water-circulating and dish-holding means in said tank means, said assembly also including a water supply and drain means for said tank means and sink means, said sink drain means including a lower section having a top opening exposed when said sink means is swung upward, wherein the improvement comprises:

and auxiliary faucet-conduit located within said tank means and pivotally moveable between an extended position corresponding to placement of the discharge opening of said faucet-conduit opposite and above said top opening and a retracted position, and valve means connected to and rotating with said faucet-conduit and operative to open a flow of water from said water supply through said faucet-conduit with said faucet-conduit in said extended position, and close said flow with said faucet-conduit out of said extended position.

3. A dishwasher assembly including tank means and sink means pivotally connected to said tank means, said sink means forming an upwardly-opening hinged cover for said tank means, and also including water-circulating and dish-holding means in said tank means and drain means for said tank means and sink means, said assembly including utility controls and also including utility connection means adjacent the lower extremity of said assembly, wherein the improvement comprises:

a flange extending laterally from the top periphery of the front and sides of said tank means beyond the vertically projected peripheral outline of the portion of said assembly normally below said flange, said flange providing the primary support point for said assembly, said pivotal connection being provided by hinge means spaced from the rear of said assembly, and wherein the periphery of said sink means closely overlies said flange in spaced relationship to form an air exhaust duct.

4. An assembly as defined in claim 3, wherein said sink periphery extends laterally beyond said flange, and terminates in spaced relationship above the plane of the underside of said flange.

5. An assembly as defined in claim 4, additionally including opposite offsets in said tank means and sink means forming a serpentine passage communicating between the interior of said tank means and said exhaust duct.

* * * * *